United States Patent [19]

Ronan et al.

[11] Patent Number: 5,045,217

[45] Date of Patent: Sep. 3, 1991

[54] APPARATUS FOR CLEANING AN OIL SPILL OFF OF A BEACH

[76] Inventors: Charles B. Ronan, 1013 E. Dimond #439; William R. Breedlove, 11711 S. Gambell, both of Anchorage, Ak. 99515; Siegfried Jokiel, 8461 Long Horn Dr., Anchorage, Ak. 99516

[21] Appl. No.: 470,569

[22] Filed: Jan. 26, 1990

[51] Int. Cl.[5] ..... C02F 1/40

[52] U.S. Cl. ..... 210/776; 210/175; 210/242.3; 210/242.4; 210/923; 210/924; 405/263; 440/39

[58] Field of Search ..... 210/774, 776, 783, 791, 210/175, 187, 242.3, 242.4, 396, 400, 923, 924, 925; 208/390, 391; 405/263, 15; 440/39

[56] References Cited

U.S. PATENT DOCUMENTS

| | | | |
|---|---|---|---|
| 3,339,516 | 12/1965 | Lenci | 440/39 |
| 4,033,869 | 7/1977 | McGrew | 210/242.2 |
| 4,194,978 | 3/1980 | Crema | 210/242.2 |
| 4,341,637 | 7/1982 | Smith | 210/662 |
| 4,526,514 | 7/1985 | Duverne | 417/61 |
| 4,755,306 | 7/1988 | Lovgren | 210/773 |

*Primary Examiner*—Robert A. Dawson
*Assistant Examiner*—David Reifsnyder
*Attorney, Agent, or Firm*—William D. Hall

[57] ABSTRACT

A barge has a submersible pump which pumps sea water from a depth of about three feet, heats the water, and uses a boom to direct the heated sea water on the rocks and sand on the beach. The oil which is washed from the beach enters the sea around the barge but is contained by a containment boom. The floating oil in the water around the barge is then recovered by conventional skimming techniques. The sea water from the pump is heated by oil-fired burners. The temperature of the water may be controlled by regulating the amount of heating oil fed to the burners or by varying the number of oil-fired heaters used. The boom is a 100 foot long articulated structure which can be moved across the beach at will to direct the hot water on any desired part of the beach. Either a series of nozzles producing high intensity fan sprays on a series of nozzles producing cone sprays may be selected.

6 Claims, 5 Drawing Sheets

FIG. 3
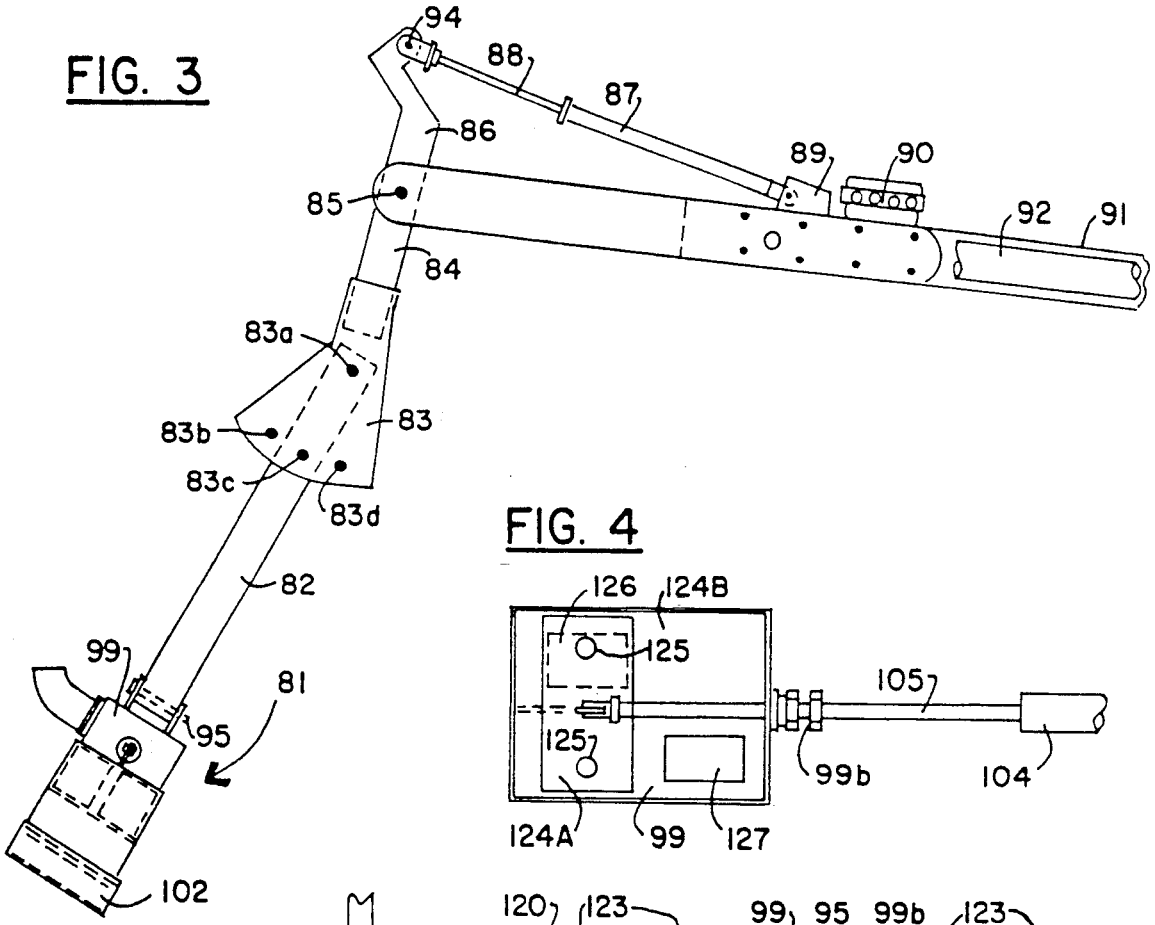
FIG. 4
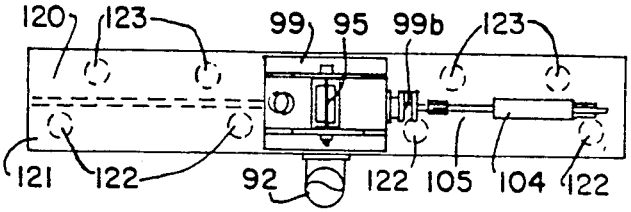
FIG. 6
FIG. 5
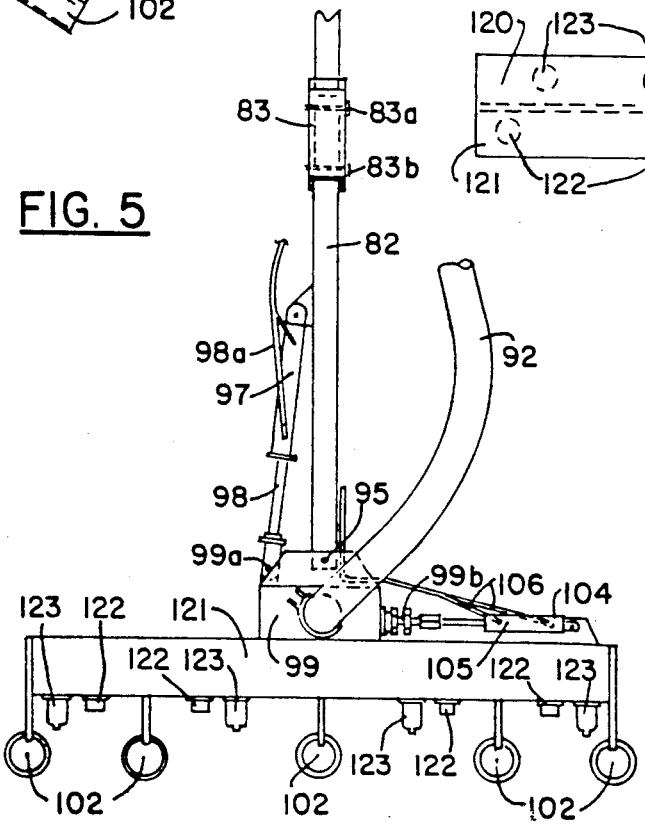

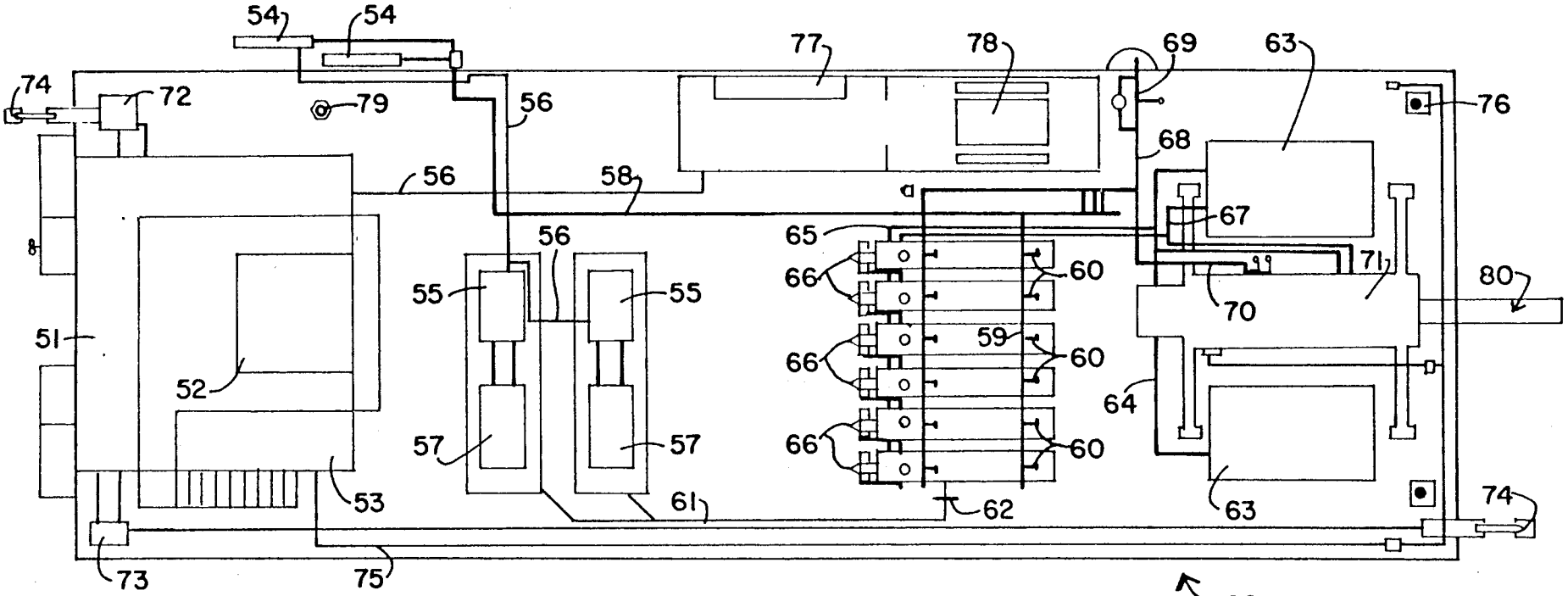
FIG. 7
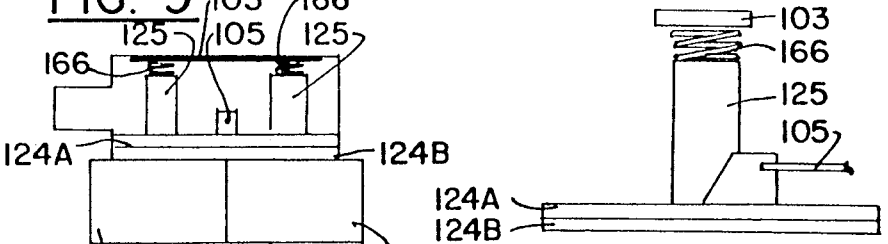
FIG. 9A
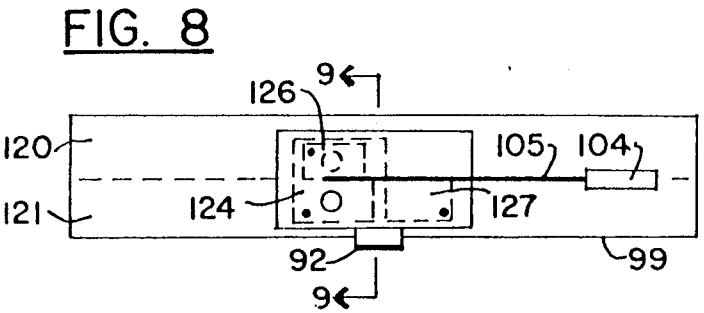
FIG. 8
FIG. 9

APPARATUS FOR CLEANING AN OIL SPILL OFF OF A BEACH

BACKGROUND OF THE INVENTION

Beaches polluted by an oil spill have been cleaned in the past by land-based methods or apparatus which removes the oil laden rocks and/or sand, washes them, and then replaces them.

SUMMARY OF THE INVENTION

The present invention utilizes a barge which has a submersible pump which pumps sea water from a depth of about three feet, heats the water, and uses a boom to direct the heated sea water on the rocks and sand on the beach. The oil which is washed from the beach enters the sea around the barge but is contained by a containment boom. The floating oil in the water around the barge is then recovered by conventional skimming techniques.

The sea water from the pump is heated by oil-fired burners. The temperature of the water may be controlled by regulating the amount of heating oil fed to the burners or by varying the number of oil-fired heaters used.

In a preferred embodiment the boom is a 100 foot long articulated structure which can be moved across the beach at will to direct the hot water on any desired part of the beach. Either a series of nozzles producing high intensity fan sprays or a series of nozzles producing cone sprays may be selected.

The exact configuration of the articulated boom and the selection of the cone or fan-spray nozzles, are controlled at an operator's panel on the barge.

DESCRIPTION OF THE DRAWINGS

FIG. 3 is a side view of the free end portion of the articulated boom including the distribution box and the manifold (head) for the nozzles.

FIG. 4 is a cross-section of the distribution box 99 of FIGS. 3 and 5.

FIG. 5 is a front view of the boom, the distribution box 99, the water manifold 121, the nozzles 122 and the rock guards 102.

FIG. 6 is a plan view of the combination of the distribution box 99 and the water manifolds 120 and 121.

FIG. 7 is a plan view of the barge.

FIG. 8 is a cross-section of the distribution box 99 and manifolds 120 and 121.

FIG. 9 is an end view, partly in section, of the distribution box 99, the nozzles 122, 123 and the water manifolds and 121.

FIG. 9*a* is a detail view of a portion of FIG. 9.

DETAILED DESCRIPTION OF THE DRAWINGS

Figure 1:
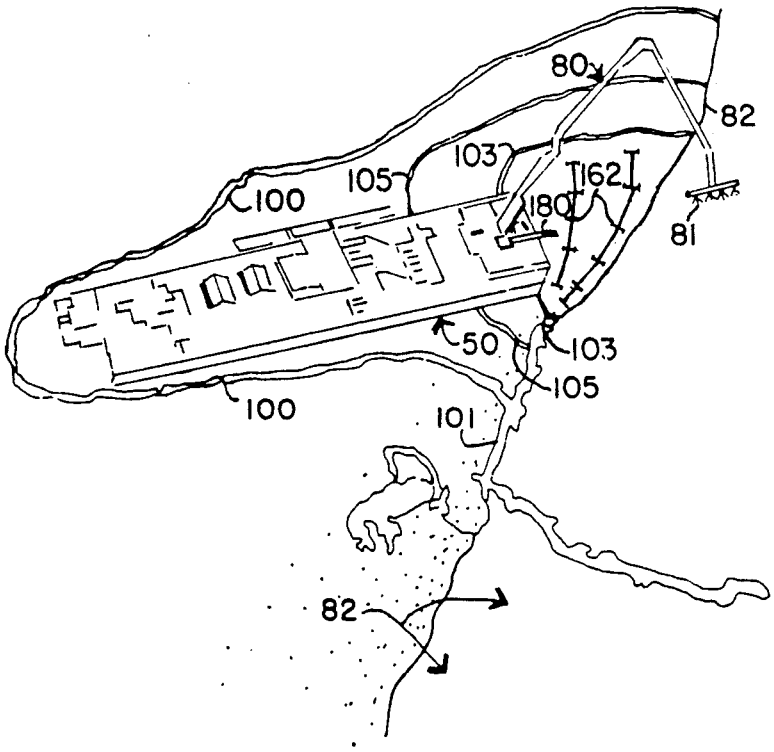
FIG. 1 is a top view of the beach, the ocean, the barge and the boom.
Figure 10:
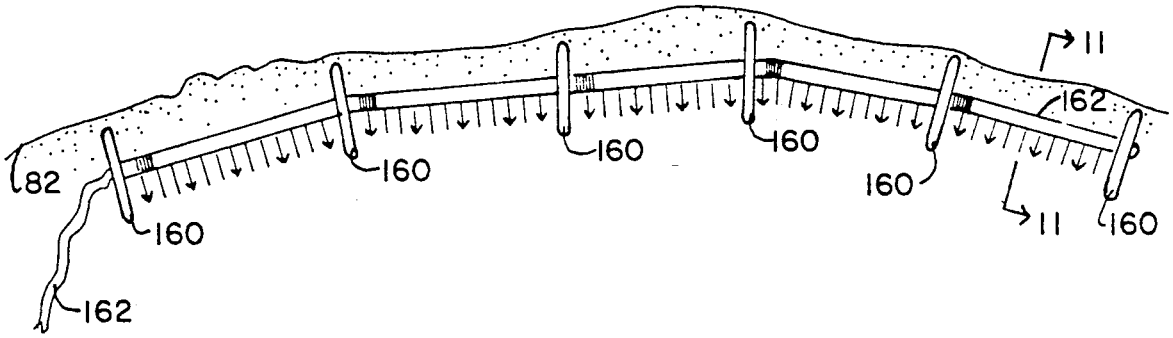
FIG. 10 is a plan view of the apparatus for washing the oil, that has been washed off of the rocks and sand, away from the land.
Figure 11:
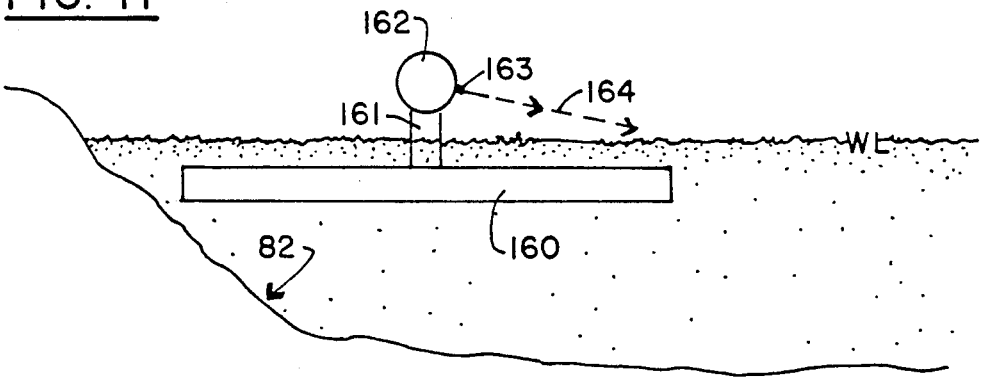
FIG. 11 is a view taken along line 11—11 of FIG. 10.
Figure 12:
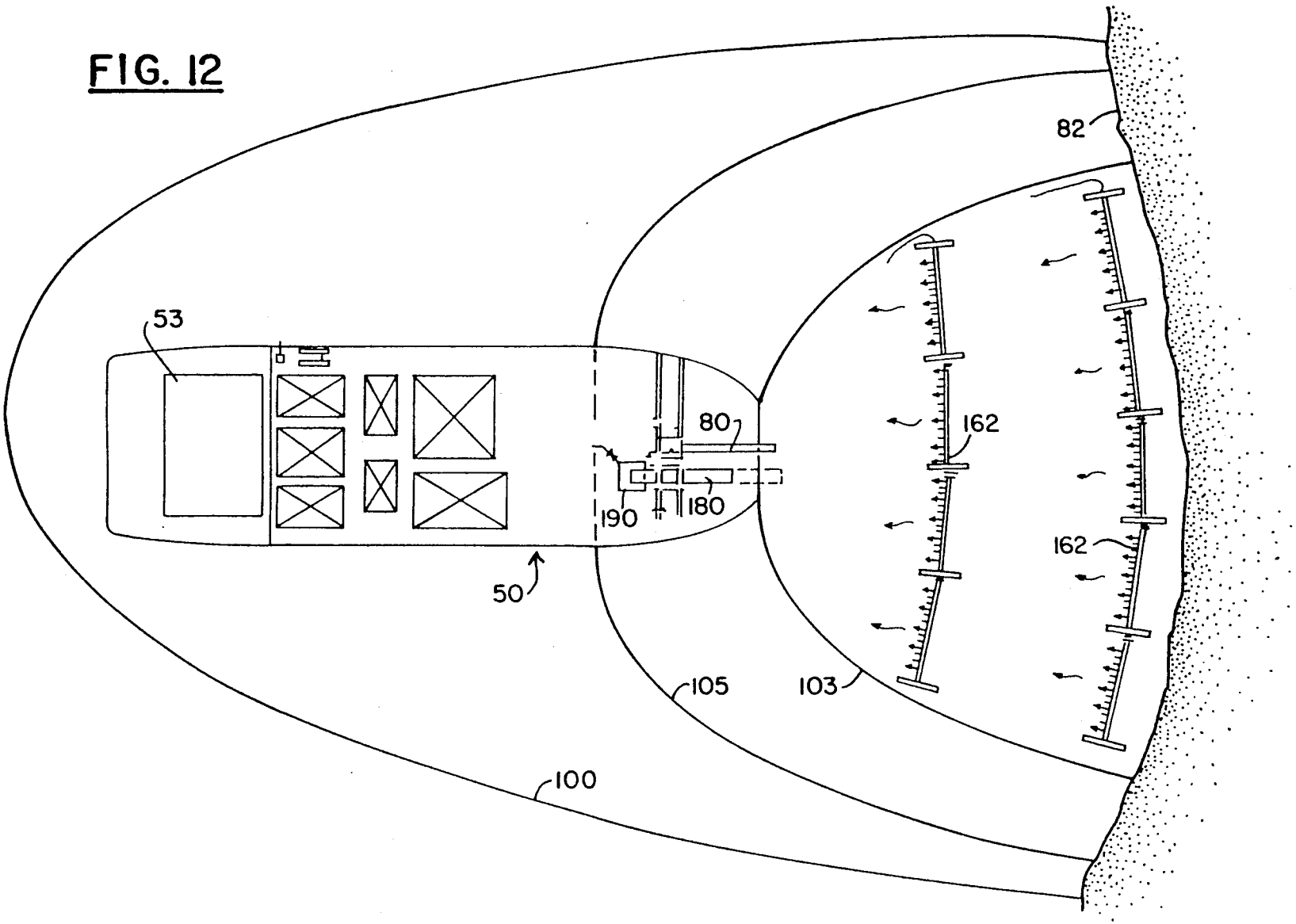
FIG. 12 is a top view of the barge, the skimmer, and the apparatus for washing the oil away from the land.

FIG. 1 shows a typical beach 82 of sand and rocks polluted by oil, from an oil spill, that has been washed onto the shore. A barge 50 carrying the equipment shown and described in connection with FIG. 7 has a 100 foot boom 80 terminating in a head 81 that squirts high intensity hot water onto the beach. There is a containment boom 100, starting at the shoreline, and extending around barge 50 and then back to the shoreline. Additional containment booms 103 to 105 may be employed. The containment booms 100, 102, 103, and 105 are of the well known type for containing oil after oil spills. The apparatus 162, shown and described in conjunction with FIGS. 10 and 11 assists in moving the oil away from the land.

The hot water discharged from head 81 washes the oil off of rocks and sand and then away from shore 82. That oil is, however, contained by containment boom 103. Any oil that floats by boom 103 is contained by one or more of back-up booms 105 or 100.

The oil is contained by the containment booms and recovered in any conventional prior art manner such as by one or more conventional skimmers 180 of well-known construction.

Figure 2:
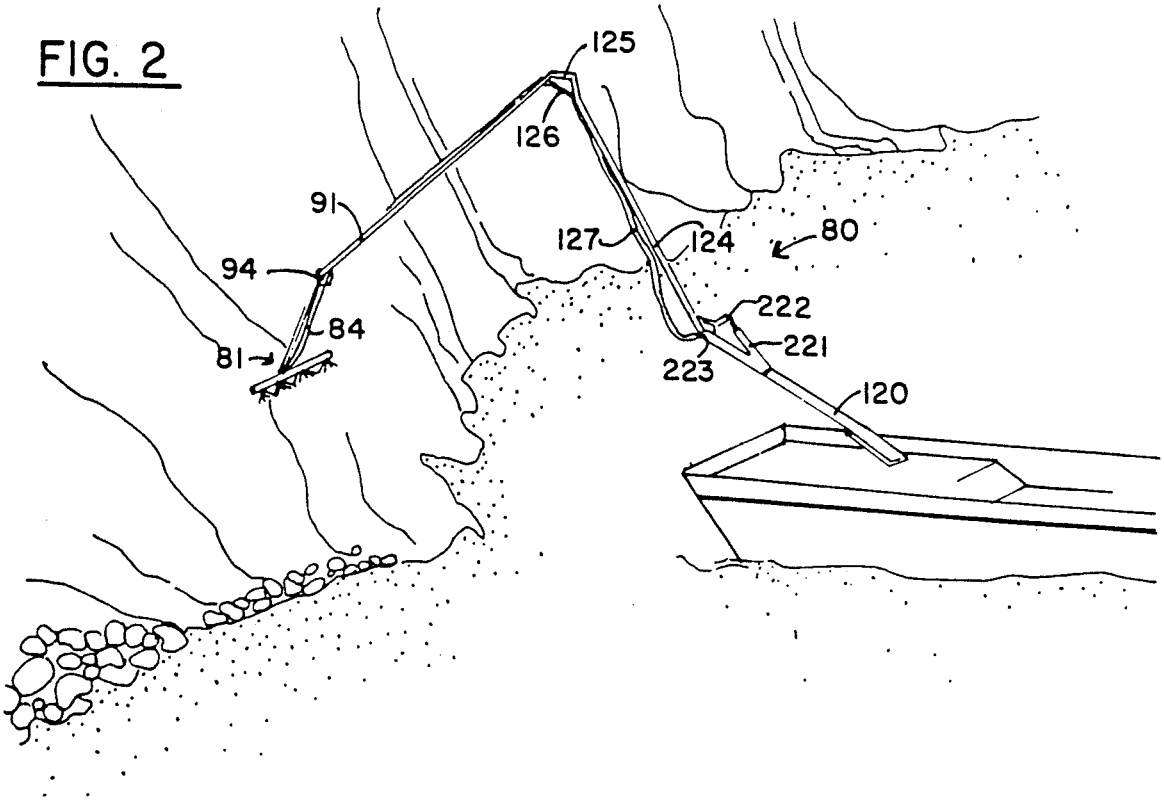
FIG. 2 is a side view of the articulated boom.

FIG. 2 illustrates the articulated boom 80 (FIG. 1) in more detail. The first section 120 of the boom 80 is mounted on barge 50, for rotation about a vertical axis, and is also mounted to rotate about a horizontal axis. Suitable hydraulic rams to move section 120 about horizontal and vertical axes are employed and these hydraulic rams are controlled by controls positioned on the barge 50 so as to be convenient to the human operator. The second section 124 of the articulated boom 80 is pivoted to the first section 120 at 223. A hydraulic cylinder 221 moves a piston 222 in and out and thereby controls the angle between sections 120 and 124. The pressure in hydraulic cylinder 121 is under the control of the aforesaid human operator.

Running alongside of boom 80 and carried thereby is rigid pipe 92 which may be 4 inches in diameter and carries the hot water from barge 50 to head 81. (See FIG. 3).

The third section 91 of the articulated boom 80 is pivotally connected to the second section 124 at 125. Here again there is a hydraulic cylinder piston combination 126 under the control of the aforesaid human operator for varying the angle between sections 91 and 124.

Referring to FIG. 3 the leg 84 is pivotally connected to section or leg 91, at 85. An extension 86 of leg 84 is pivoted at 94 to piston rod 88 of hydraulic cylinder 87 which in turn is pivotally connected to section 91 at 89. Thus, the aforesaid human operator may vary the angle between legs 91 and 86 by operating controls on the barge which change the pressure in hydraulic cylinder 87.

The leg 84 is pivotally connected to leg 82 at 83*a*, and the leg 82 may be manually moved to any one of three positions 83*b*, 83*c* and 83*d*. The leg 82 latches itself into the one of positions 83*b*, 83*c* or 83*d* into which it is set.

The head 81, which comprises distribution box 99, water manifolds 120 and 121, nozzles 122 and 123 and rock guards 102, is pivoted to leg 82 at 95.

Referring now to FIG. 5, it is noted that hydraulic cylinder 97 has piston rod 98 which is pivoted to distribution box 99 at 99*a*. The fluid is fed to cylinder 97 through oil lines 98*a* and the fluid pressure is under the control of the aforesaid human operator who may, therefore, tilt the manifolds 120 and 121 as desired.

There are two sets of nozzles. Both nozzles produce a stream of water. The word "stream" includes all forms of water discharge including sprays and solid jets of water. One set are nozzles that produce a high intensity fan spray. These are nozzles 122 fed by water manifold 121 (See FIG. 9 and 6). The other set of nozzles 123 produce a cone shaped output stream and are fed by water manifold 120. The aforesaid operator, by operating the controls on the barge 50, may vary the pressure in hydraulic cylinder 104 to move the piston rod 105. The piston rod connects to valve plate 124*a*. Springs 166 are guided by tubes 125. Plate 124*a* is pressed downwardly by plate 103 via springs 166. When the piston rod 105 is in its extended position shown in FIGS. 4 and 8 the valve plate 124*a* covers the inlet hole 126 to rear water manifold 120 but allows water via inlet hole 127 into front chamber 121 and to pass out of nozzles 122 onto the beach. But when hydraulic cylinder 104 retracts piston rod 105, the inlet hole 126 is opened and inlet hole 127 is closed, so that water now floods water manifold 120 and passes out nozzles 123 and onto the beach. The inlet holes 126 and 127 are in a Teflon plate 124*b* over which valve member 124*a* may slide.

FIG. 7 is a top view of barge 50. The engine room 51 has engines for driving the propellers to move the barge through the water. The pilot house 52 and the galley 53 serve their usual purpose on a barge. The barge 50 has all of the equipment required to navigate the seas to any desired extent. There are two submersible electrically driven pumps 54 one or both of which may be lowered by davit 79 into the sea water to any desired depth, but preferably to a depth of about three feet. This depth is sufficient to obtain clean water free of the oil that may be floating on the surface. The pumps 54 are fed by 480 volts, three phase, alternating current by the diesel driven alternator 55. A cable 56 carries the current from the alternator 55 to the pump 54 at 480 volts, three phase. The cable 56 also carries 240 volts, single phase, to the engine room and to other parts of the barge. There are six oil-fired burners 66, each of which employs an electric motor to squirt a mixture of oil and air in the form of a mist into the oil burner combustion chamber. These six electric motors receive their power from alternator 55. There are two alternators 55, but one is a back-up for the other to be used in event of a failure of the other machine.

Water under pressure from the pumps 54 are fed via pipe 58 to a manifold 59 which feeds six pipes 60 that carry the water through a circuitous path above the oil burners so that the water is heated. The control panel 62 has controls to reduce or increase the flow of oil to the six oil burners 66 or to shut down one or more of the six oil burners or to operate valves in the water lines to cause the water to flow through only selected ones of the six oil burners. The oil burners are fed with oil from the two 5000 gallon tanks 63 through pipes 64 and 65. Excess oil is returned to the tank via pipe 67, in the usual manner. The sea water that has been heated by the oil burners flows in pipe 68 to the emergency dump valve 69 and to rigid pipe hose 92 on boom 80 via pipe 70. The emergency valve 69 quickly permits the sea water to be dumped overboard if deemed necessary.

The mounting mechanism for articulated boom 80 is in the enclosure 71. The winches 72 and 73 raise and lower anchor 74. Electrical cable 75 feeds working lights. Work bench 77 and table 78 may be provided in a room on the barge. The barge is preferably 40 feet wide and 115 feet long. Fire monitors 76 are supplied with water from piping 68.

Basically, our beach cleaning system has a 100 plus foot articulating boom 80 with a six foot wide head 81. Sea water is pumped through the system and sprayed onto the beach through variable (volume and pressure) spray nozzles 122 or 123 in the head 81. The main asset of the system is versatility. The variable spray nozzles in the head allow for several spray patterns and intensities which can be adjusted for the best washing configuration for each of the many different surfaces washed.

The pressure and temperature can be easily varied to provided 500 gallons per minute (GPM) with one pump 54, and 800 GPM with two pumps 54, of sea water to the beach with any variation from 0 pounds per square inch (PSI) to 100 PSI and from ambient water temperature (35° to 50° F.) to 140 degrees Fahrenheit respectively. The head 81 is hydraulically controlled to swivel and spray those hard to reach cracks, crevices and vertical surfaces. All systems are controlled and operated from a viewing/operating platform aboard the self-propelled floating barge 50.

There are two 135KW to 150KW generators or alternators 55. Each generator set is capable of running all of the system's equipment aboard. Each provides both 480V 3-phase and 120V/240V single-phase power through a control panel. Duplicity is built into the system because the sweep equipment needs to be operational at all times and the oil spill locations do not generally occur where equipment breakdowns can be easily repaired. Both generator sets should be the same brand and model. Each generator set is skid-mounted with a protective canvas cover. A 500 gallon fuel tank is also mounted on each skid. The fuel tanks are equipped with Coast Guard approved vents. A containment pan is installed under the tank and generator set to catch any possible fuel or oil spillage. Each generator set skid is both welded and chained to the barge deck.

The submersible pumps 54 are 3-stage 6" diameter Fairbanks-Morse Turbines driven by 40 HP 480V 3-phased Franklin Motors. Each pump 54 is capable of providing 500 GPM at 90-plus pounds per square inch (PSI) to the head 81 (after system losses). The system was designed to operate with one pump, however, both pumps can be operated. The system provides approximately 800 GPM at 90-plus PSI to head 81 by using both pumps. Each pump is encased in a 12" open-ended protective pie coffin with lifting eyes. The water from pumps 54 passes through pipe 58 to manifold 59 to pipes 68 and 70, to rigid pipe 92 which runs along boom 80, to head 81. A davit 79 with chain hoist is used to lift each pump 54 (not shown) to and from the water. The pump is then held in position by two chains attached to the pump coffin and secured to two hinged outriggers which are attached to the deck and positioned to hold the pump 54 away from the side of the barge. A submersible rated power cable 56 connects the pump 54 to the generator control panel. A 6" flexible pressure hose connects the submersible pump 54 to the deck piping 58. The piping arrangement from the from the deck pipe 58 may be valved such that the water can be routed in various directions, i.e.:

A. All/Part/None of the water through the water heaters 66.

B. Hot/Combination/Cold Water through the head 81.

C. Hot/Combination/Cold water through each fire monitor system 76 located on the barge bow.

D. Hot/Cold water through the overboard dump line 69.

The piping system is built using Victaulic pipe and fittings. This versatile type of pipe system allows for great flexibility as well as easy modification.

The fire monitor 76 is an Omega Style 3526 brass single waterway monitor. The monitors 76 may be used to help in washing the cliff areas where the barge 50 can be positioned very close to the work area.

The piping system and equipment is protected with an Ames A820 pressure relief valve 69. This is a 6" diaphragm type valve set at 100 PSI and piped to dump overboard. The pressure relief valve has a closing dampener to prevent shocking the system (water hammer).

The system utilizes six (6) diesel fueled water heaters 66, from PVI Industries, Inc. Other equal heaters could be utilized. The water heaters 66 were specially built in pairs on skids with flanges hot and cold water pipe heaters to allow each heater unit to be field installed in parallel.

Each heater has an input rating at 7,999,999 BTU/Hr. and uses 57 GPH of diesel fuel at 200 PSI fuel pressure when on high fire. Each heater would heat 125 GPM of seal water to a $\Delta T$ of 100 degrees Fahrenheit.

The water heaters utilized firepower (Bentone) type burner units.

The system was designed to operate using one submersible pump 54 and four water heaters 66 thus providing a temperature of 100 degrees Fahrenheit for 500 GPM of sea water. To alter the temperature, the burners can be switched from high flame to low flame or one or more water heaters 66 can be added to or substracted from the system.

Heated water was the key for removing oil from the beaches.

Because of the poor quality of fuel (due to water) which is often delivered to the tanks 63, the fuel supply from the onboard tanks 63 to the equipment is drawn from the tops of each tank and passed through parallel fuel/water separator filters prior to going to the equipment.

Each fuel tank is also equipped with a line to draw contaminated fuel, i.e., water, from the bottom of the tank and send it to a contaminated fuel storage tank. Each tank also has a fuel spill containment built under the tank to catch any spilled fuel. All main piping supply and return lines are black iron. The individual drop lines between the mains and the burner are type "M" soft copper.

The three stage articulating arm 80 is a modified Putzmeister Concrete Pump or similar equipment. The horizontal arm reach varies depending upon the model utilized. However, a reach of 100 feet from the bow of the barge is recommended. A remote control (electric over hydraulic) is used to hydraulically control the movements of the articulating arm. The operator works the toggle switch controls from an elevated platform across the bow of the barge.

The head 81 was designed as an independent unit to be attached to the end of the articulating boom 80. The sweep head unit consists of three legs, 91, 84, 82, and a head 81. The first leg 91 is attached to the end of the articulating boom 80. The second leg 84 is pinned to the first leg, and by use of a hydraulic cylinder 87, can be swung in and out. The third leg 82 is pinned to the second leg 84 in one of several fixed positions as desired to give optimum spray angle on the surface to be washed. The head 81 is pinned to the third leg 82 and moved sideways by the use of another hydraulic cylinder. The head 81 is compartmentalized with four spray nozzles in each compartment. A hydraulically operated diverting valve **124*a* is utilized to direct water to either or both head compartments 120 or 121**. The nozzles for each compartment can have different spray patterns and intensities, thus allowing the operator to vary the spray as beach conditions dictate.

The head 81 may utilize three different types of nozzles: A) 60 degree full cone coverage; B) 60 degree fan coverage; and C) Fire hose nozzle set as desired. Each nozzle was rated at 125 GPM at 100 PSI. The head 81 is generally operated at a height of two to six feet above the washing surface.

Because the wave action against the vessel 50 carrying the articulating boom 80 accentuates the movements of the head 81, it was necessary to install bumpers 102 on the head 81 to protect the nozzles from damage by hitting the rocks.

Separate hydraulic lines are run from the hydraulic system of the articulating boom to a set of electric solenoid valves 90 mounted on top of the first leg of the head 81. The solenoid valves 90 control each of the three hydraulic cylinders 87, 97, 104, on the head 81. A control cable is run from the solenoid valves 90 along the articulating boom 91, 124, 120 to a hand held control which is operated from the viewing/operator platform by the aforesaid human operator. It is, therefore, unnecessary to run separate hydraulic lines from the several hydraulic cylinders 87, 97, 104, 122 and 126 to the barge 50. Instead, a single hydraulic line may run from the barge to the input of each of solenoid valves 90. These valves 90 may be selectively electrically controlled one at a time from a position on the barge convenient to the human operator. A separate hydraulic line then runs from the hydraulic outlet of each valve 90 to one of the hydraulic cylinders 87, 97, 104, 122 and 126. Thus, the human operator may control any hydraulic cylinder by opening the valve 90 complementary to that cylinder and by then controlling the pressure in the hydraulic line from the barge to the valves 90.

An extended head was developed for use on beaches not having abrupt contour changes. This head has one foot in length and two nozzles added to each end. (The head is eight feet long with twelve nozzles.)

The system was effective in washing the oil from the beaches and back into the water. However, the oil would hang right at the shoreline, thus making it difficult to recover and also causing re-oiling of beaches. Initially, at our direction, people with hoses would mist the water surface and cause the oil to move out to the containment booms 100, 102, 105, where it could be recovered. Near the conclusion of the clean up effort, we developed oil herding system (FIGS. 10, 11) to solve this problem. The oil herding system worked well during the tests, however, the project concluded prior to the system being utilized under actual production conditions.

The system consists of series of 10' pieces of 4" PVC tubing 162 with ¼" holes 163 drilled lengthwise and spaced 2½ inches between centers. The tube sections 162 have floats 160 every 10' to hold them two or three inches above the water. The tubes 162 are connected by flexible hoses 170 to allow each section to closely follow the shoreline contour. The supports 161 support tubes 162 on the floats 160.

The floats 160 are approximately 6' long and installed perpendicular to the water tube 162. The floats 160 buoy the water tube 2" to 3" above the water surface in addition to holding the water tube 3 ft. from the shoreline.

One end of the oil herding system is capped and a 2" pump is attached to the other end. Water is pumped at 40 PSI through the ¼" holes which direct water parallel to the water surface and away from the shore. This causes the water surface to move out from the shoreline, thus carrying the skim oil with it.

As indicated above, the oil that is washed off of the rocks and sand is further washed out to sea toward the containment booms such as 100. This is done by having a series of floats 160 in the water adjacent the shoreline. A hose 162 mounted on supports 161 has holes 163 for directing a spray of water from hose 162 away from the shore 82.

The skimmer 180 is preferably of the well known commercial type known as Egmopol. It skims oil from the water on said vessel for selecting the portion of the land to be cleaned.

The skimmer 180 is a conventional one that has an endless belt having raised portions for holding the oil on the belt until the belt is above container 180*a* at which time the oil spills into container 180*a*. The skimmer 180 is preferably mounted so that it can be retracted from the water when not in use. The orifices 163 in pipes 162 cause the water to move away from the shore 82 and toward the skimmer.

We claim to have invented:

1. Apparatus floatable in a body of water for cleaning land, comprising:

a vessel that floats on a body of water, means for moving said vessel relative to the land to be cleaned, means for drawing water from said body and delivering it to said vessel, means for delivering the water on said vessel, that was drawn from said body, to the land to be cleaned, including means, controllable on said vessel for directing a stream of water on the portions of the land to be cleaned, said means for delivering the water including an articulated boom for directing the water on the portions of the land to be cleaned, containing means for containing the floating polluting material washed from said land into said body of water, said containing means being means that at least partially floats on the water, and skimming means for recovering the contained floating polluting material.

2. Apparatus as defined in claim 1 including means on said vessel for heating the water, that was drawn from said body, before it is directed at the land.

3. Apparatus floatable in a body of water for cleaning land, comprising:

a vessel that floats on a body of water, means for moving said vessel relative to the land to be cleaned, means for drawing water from said body and delivering it to said vessel, means for delivering the water on said vessel, that was drawn from said body, to the land to be cleaned, including means, controllable on said vessel for directing a stream of water on the portions of the land to be cleaned, said means for delivering the water including an articulated boom for directing the water on the portions of the land to be cleaned, a head on said boom, first means on said head for delivering two types of output streams from said head onto said land, and control means, controllable from said vessel, for selecting the type of output stream from said head.

4. Apparatus as defined in claim 2 in which said first means comprises: first and second manifolds, means associated with said first manifold to provide one form of output stream, means associated with said second manifold to provide another form of output stream, and said control means including means for selecting the one of said manifolds which is fed by said water.

5. Apparatus floatable in a body of water for cleaning land, comprising:

a vessel that floats on a body of water, means for moving said vessel relative to the land to be cleaned, means for drawing water from said body and delivering it to said vessel, means for delivering the water on said vessel, that was drawn from said body, to the land to be cleaned, including means, controllable on said vessel for directing the water on the portions of the land to be cleaned, submersible pump means for drawing said water from said body, and means, supporting said pump means, for selecting the depth from which the water is drawn.

6. Apparatus for cleaning oil from beaches or other land masses, comprising:

a vessel for navigating bodies of water, means carried by said vessel for drawing water from the body of water in which the vessel is located, heating means on said vessel for heating the water that is drawn from said body, means on said vessel for producing power to draw said water and the heat to heat said water, articulated boom means on said vessel for selecting the portion of the land to be cleaned, flexible means carried by said boom for guiding the water from said heating means along the boom, and a head on said boom for receiving the water from said flexible means and for directing such water onto the land to be cleaned, containing means for containing the floating polluting material washed from said land into said body of water, said containing means being means that at least partially floats on the water, and skimming means for recovering the contained floating polluting material.

* * * * *